United States Patent [19]

Kuroishi

[11] Patent Number: 4,919,262

[45] Date of Patent: Apr. 24, 1990

[54] PORTABLE CLOTHES COVER

[75] Inventor: Yoshitada Kuroishi, Tokyo, Japan

[73] Assignee: Unix Corp., Tokyo, Japan

[21] Appl. No.: 297,008

[22] Filed: Jan. 13, 1989

[30] Foreign Application Priority Data

Jan. 19, 1988 [JP] Japan ..... 63-4879[U]

[51] Int. Cl.[5] ..... A45C 11/00; B65D 33/14; B65D 33/24; B65D 85/18

[52] U.S. Cl. ..... 206/287.1; 206/279; 206/284; 383/23

[58] Field of Search ..... 206/278–288, 206/289; 383/87, 23; 229/87 A, 875

[56] References Cited

U.S. PATENT DOCUMENTS

| | | | |
|---|---|---|---|
| 2,626,689 | 1/1953 | Davis et al. | 206/287.1 |
| 3,295,644 | 1/1967 | Furuya | 206/287 X |
| 3,549,085 | 12/1970 | Hart | 383/23 |
| 3,782,622 | 1/1974 | Montgomery | 383/87 X |
| 3,999,656 | 12/1976 | Hydorn | 206/284 X |

FOREIGN PATENT DOCUMENTS

| | | | |
|---|---|---|---|
| 2284251 | 4/1976 | France | 206/286 |
| 524835 | 8/1940 | United Kingdom | 206/287 |
| 2097668 | 11/1982 | United Kingdom | 206/278 |
| 2111459 | 7/1983 | United Kingdom | 383/23 |
| 2113651 | 8/1983 | United Kingdom | 206/282 |
| 2118526 | 11/1983 | United Kingdom | 206/279 |

*Primary Examiner*—Sue A. Weaver

*Attorney, Agent, or Firm*—Griffin, Branigan & Butler

[57] ABSTRACT

A portable clothes cover in which the clothes hanging down from the hanger or the like can be directly suspended on the suspender member of the upper bar, then enclosed by the cover section, and the cover section thus enclosing the clothes together with the hanger or the like can be securely maintained in the folded condition by foldling this assembly in two and thereby locking the upper and lower bars to each other, followed by putting the sheath-like bag onto the cover section thus folded.

7 Claims, 6 Drawing Sheets

PORTABLE CLOTHES COVER

BACKGROUND OF THE INVENTION

The present invention relates to a clothes cover which is conveniently portable together with clothes enclosed therein.

Such clothes cover is usually used for convenient conveyance of personal clothes.

Prior art to the present invention is disclosed by Japanese Utility Model Laid-Open Application No. 1981-125725 of the applicant common to the present application.

This prior invention is illustrated by FIGS. 6 and 7 of the accompanying drawing. Specifically, a bag 40 made of resin film or the like is provided at vertically opposite ends with respective bars 41, 42 and clothes 44 are suspended within the bag 40, as shown by FIG. 6. Then, the bag 40 is folded in two together with the clothes 44 enclosed therein and thereby the upper and lower bars are brought into engagement with each other, as shown by FIG. 7, so that this assembly may be conveniently carried with a grip 43 formed on one of the bars 41 or 42.

However, according to the invention disclosed in Japanese Utility Model Laid-Open Application No. 1981-125725, the bag tends to become inflated i.e. bulges, during conveyance, since the bag is held in its folded position only by mutual locking of the upper and lower bars.

Furthermore, the locking force is insufficient to maintain the upper and lower bars mutually locked to each other during conveyance.

SUMMARY OF THE INVENTION

In view of such problems, the object of the present invention is to provide a clothes cover having upper and lower bars adapted to be maintained securely engaged with each other and thereby to improve the portability of personal clothes.

According to the present invention, this object is achieved by a clothes cover comprising an upper bar formed with a suspension member on which a hanger or the like can be suspended, a cover section extending downwards from said upper bar, and a lower bar transversely provided at the lower end of said cover section, the improvement wherein there is further provided a sheath-like bag extending from said upper bar.

More specifically, with the clothes cover constructed in accordance with the present invention, the clothes hanging down from the hanger or the like can be directly suspended on the suspension member of the upper bar, then enclosed by the cover section, and the cover section thus enclosing the clothes together with the hanger or the like can be securely maintained in the folded condition by folding this in two and thereby locking the upper and lower bars to each other, followed by pulling the sheath-like bag substantially over the folded cover section.

The cover section is prevented from becoming inflated i.e. bulging during conveyance since the sheath-like bag encloses the foled cover section while the upper and lower bars are locked to each other and the, combined locking force is sufficient to maintain these bars securely engaged with each other during conveyance. Additionally, the useful life of the clothes cover is significantly improved.

DETAILED DESCRIPTION OF THE INVENTION

Figure 1:
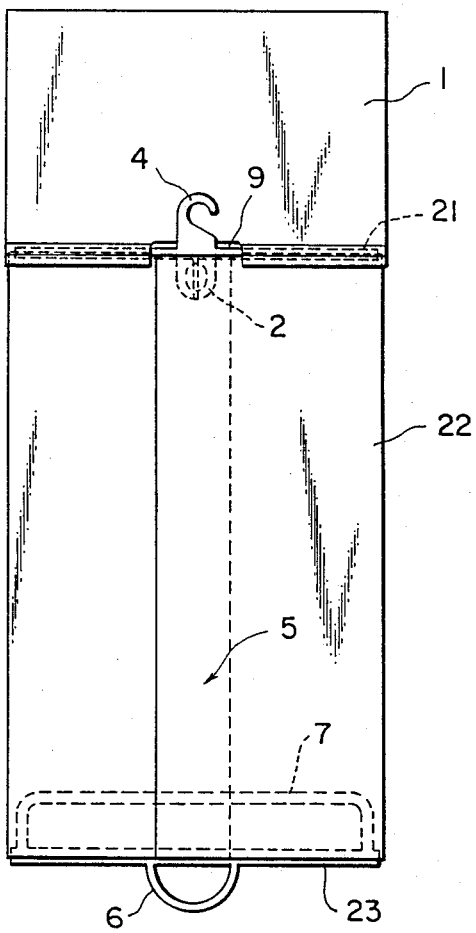
FIG. 1 is front view showin a clothes cover of the present invention as unfolded.
Figure 2A:
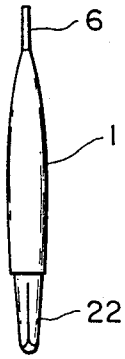
FIGS. 2A and 2B are front and side views respectively showing the clothes cover as folded.
Figure 2B:
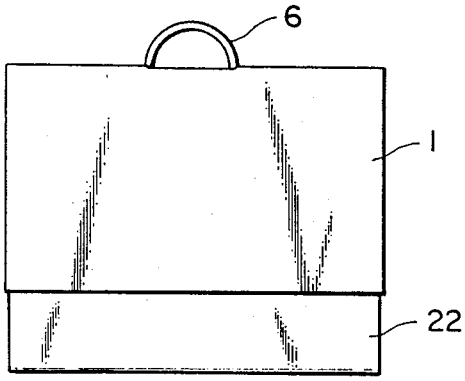

Referring to the drawing, as shown in FIGS. 1 and 2, reference numeral 21 designated an upper bar, reference numeral 22 designates a cover section carried by the upper bar 21 so as to extend downwards therefrom, and reference numeral 23 designates a lower bar provided at a lower end of the cover section 22.

The upper bar 21 is provided with a sheath-like bag 1 extending upwards therefrom.

The upper bar 21 extends transversely of the clothes cover and made of relatively rigid material such as polyethylene. This upper bar 21 is formed with a suspension member 2 with which a hanger hook or the like may be engaged.

Figure 3B:
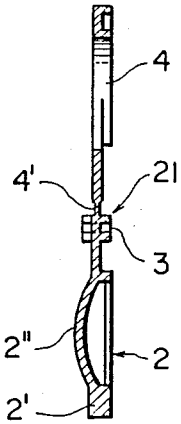
FIG. 3B is a sectional view taken along a line 3(B)—3(B) in FIG. 3A.
Figure 3A:
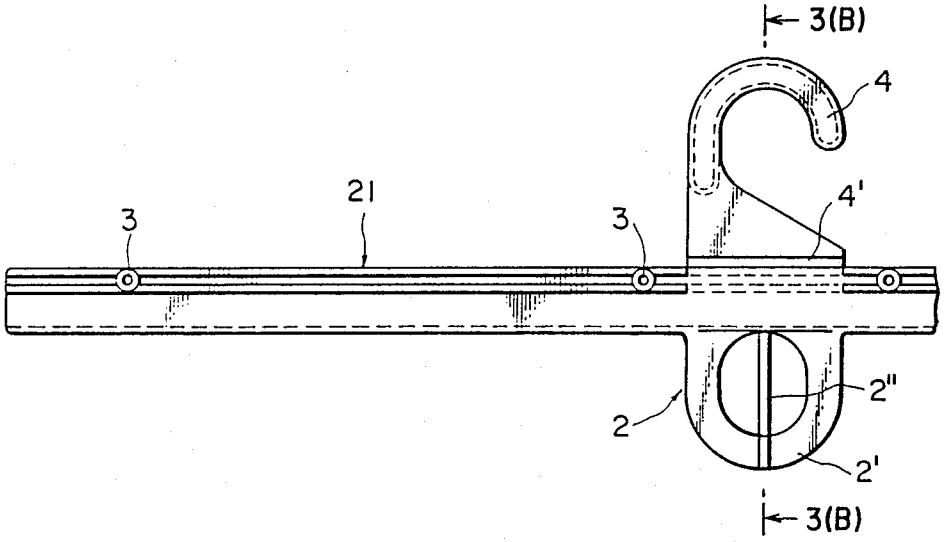
FIG. 3A is a partial front view showing an upper bar.

As shown in FIG. 3, the suspension member 2 comprises a collar 2' extending downwards from the lower end of bar 21 at a central portion thereof and a bridge 2'' vertically extending across the collar' so that a hook member or the like may be engaged with the bridge 2''. Reference numeral 3 designates snap holes into which corresponding snaps of the lower bar 23 are forced in order to lock the lower bar 23 in engagement with the upper bar 21. Reference numeral 4 designates a hook which is used to suspend the clothes cover when in its unfolded condition and coupled to the upper bar 21 by a hinge 4' which is collapsible relative to said upper bar 21.

Figure 5A:
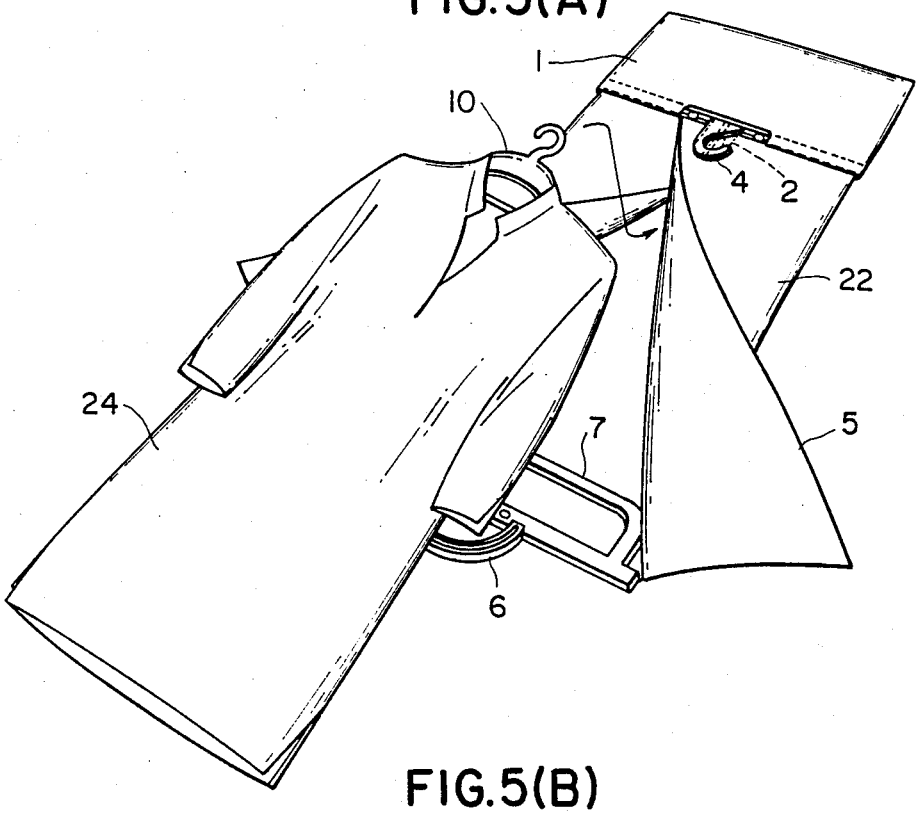
FIGS. 5A through 5E are perspective views sequentially showing how the clothes cover of the present invention is used.
Figure 5B:
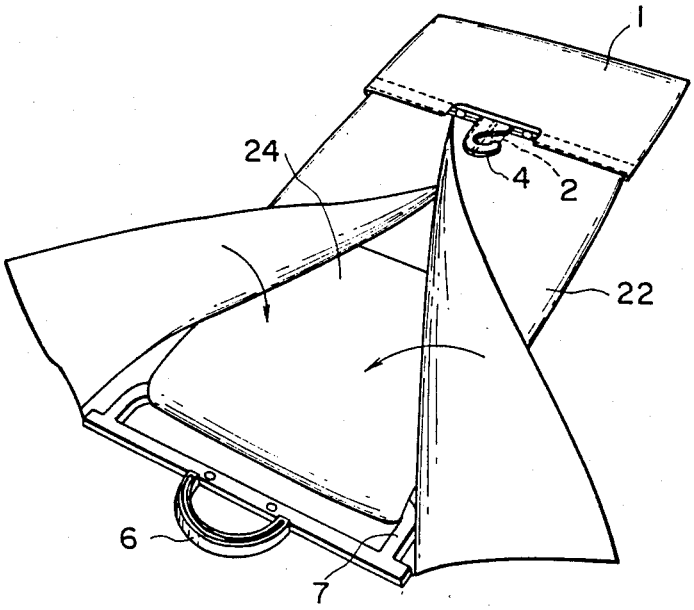

The cover section 22 extending downwards from the upper bar 21 comprises a sheath-like member made of soft resin film such as polyethylene film and serves to enclose the clothes hanging down from the suspension member 2 of the upper bar 21. This cover section 22 has an opening 5 in its front side. As seen in FIGS. 5A and 5B, the cover section 22 is adapted to be tucked i.e. lifted and moved rightwardly, along said opening 5 for taking the clothes in and out.

Figure 4B:
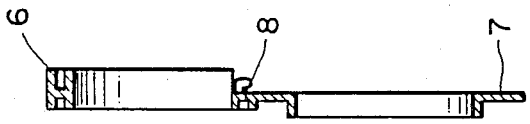
FIG. 4B is a sectional view taken along a line 4(B)—4(B) in FIG. 4A.
Figure 4A:
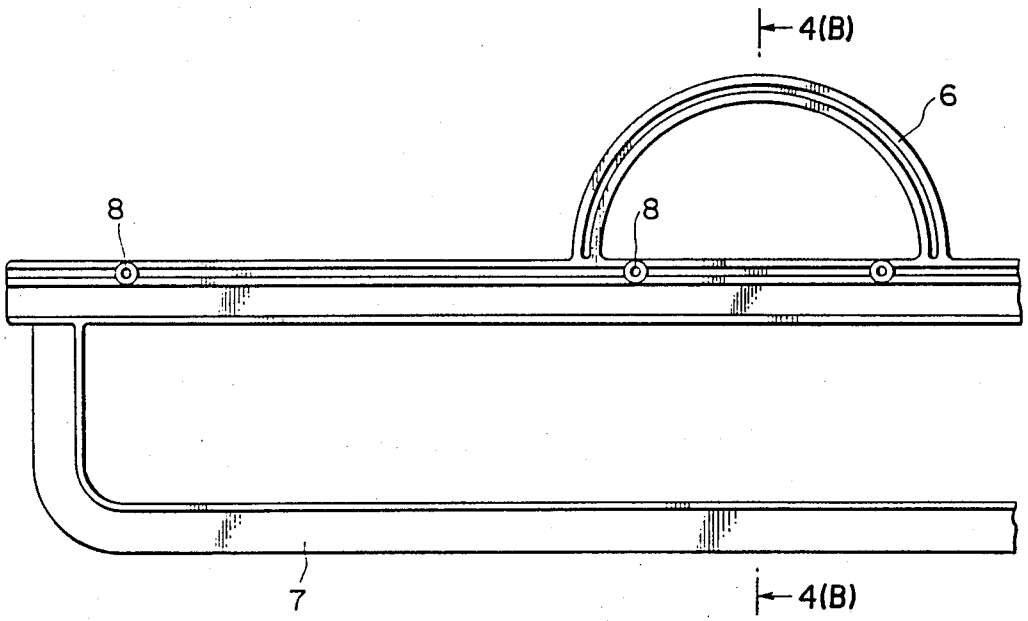
FIG. 4A is a partial front view showing a lower bar as inverted.

Referring to FIGS. 4A and 4B, the lower bar 23 provided at the lower end of the cover section 22 also extends transversely of the clothes and made of rigid material such as polyethylene as is the upper bar 21. This lower bar 23 is centrally formed at its lower end with a grip 6 serving to make the clothes cover conveniently portable. In addition, reference numeral 7 designates a further gate-shaped bar around which a lower portion of relatively tall clothes may be folded and suspended when the clothes cover is folded and reference numeral 8 designates the previously mentioned snaps provided along the lower bar 23 to lock the lower bar 23 to the upper bar 21 by forcing these snaps 8 into the corresponding snap holes 3.

The sheath-like bag 1 extending upwards from the upper bar 21 is so dimensioned to enclose the cover section 22 when the cover section 22 has been folded together with the clothes placed therein, and made of soft material such as polyethylene film. This sheath-like bag 1 is provided in its front side with a cutaway portion 9 (see FIGS. 1 and 5) which is substantially at a middle portion of a line along which the sheath-like bag 1 is joined to the upper bar 21 so that the grip 6 of the lower bar 23 may be inserted into this cutaway portion 9.

Now a manner in which the clothes cover of the invention is used will be described in reference with FIG. 5.

The cover section 22 is opened left- and rightwards along the opening 5, as shown in FIG. 5A. After the clothes 24 have been placed into the cover together with a hanger 10 from which such clothes hangs down, said hanger 10 is suspended on the suspension member 2 of the upper bar 21 provided within the cover section 22.

Then, the lower portion of the clothes is folded around the folding bar 7, as seen in FIG. 5B, and the cover section 22 is closed again along the opening 5.

Figure 5C:
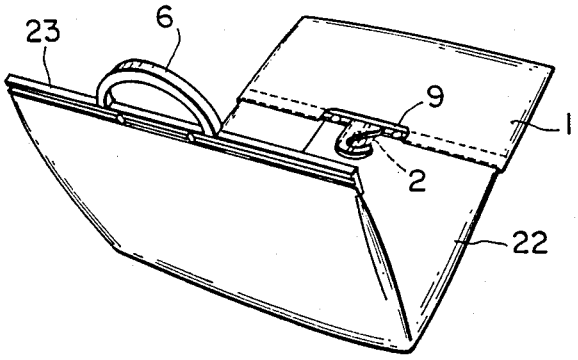
Figure 5D:
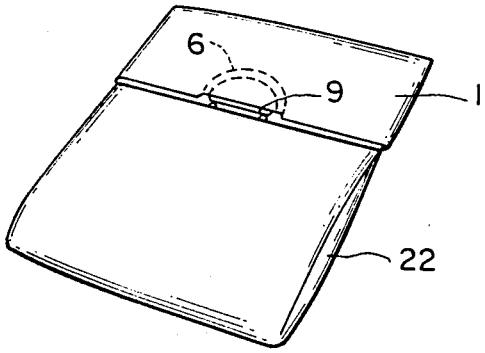
Figure 5E:
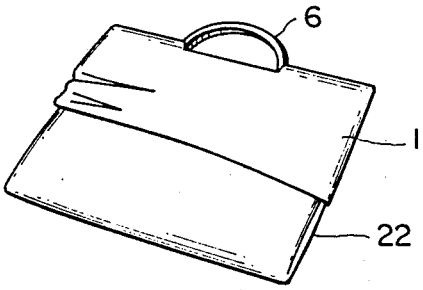
Figure 6:
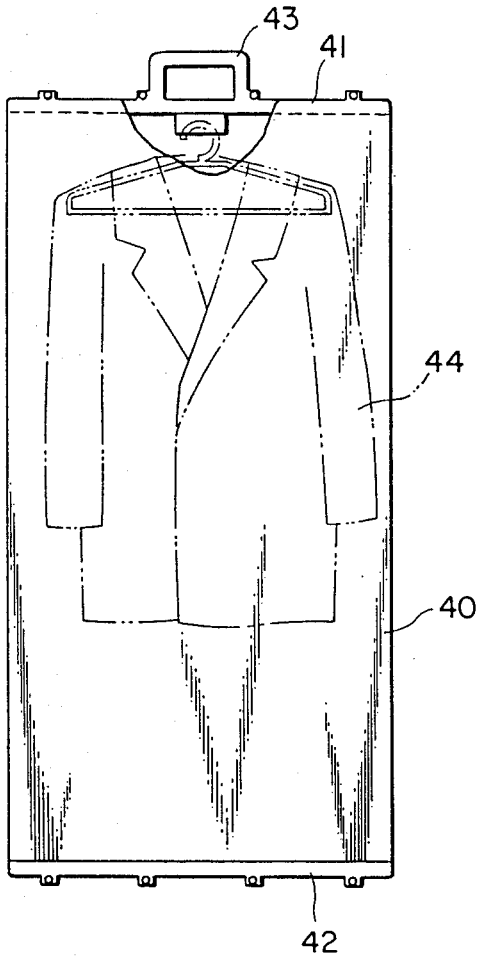
FIG. 6 PRIOR ART
FIGS. 6 and 7 are front and side views respectively showing the clothes cover disclosed in Japanese Utility Model Laid-Open Application No. 1981-125725 as unfolded and folded.
Figure 7:
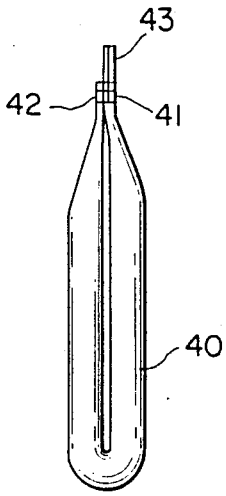
FIG. 7 PRIOR ART

The cover section 22 now enclosing therein the clothes 24 is folded in two along a longitudinally middle line thereof, as shown by FIG. 5C. Then the grip 6 formed on the lower bar 23 is inserted through the cutaway portion 9 in sheath-like bag 1, and the upper and lower bars 21, 23 are locked to each other by forcing the snaps 8 into the corresponding snap holes 3, as shown by FIG. 5D.

Finally, the sheath-like bag 1 is turned inside out and pulled onto the cover section 22 and thereby a configuration preferable for portability is achieved.

As will be apparent from the foregoing description, with the clothes cover constructed in accordance with the present invention, the clothes hanging down from the hanger 10 or the like can be directly suspended on the suspension member 2 of the upper bar, then enclosed by the cover section 22, and the cover section 22 thus enclosing the clothes together with the hanger 10 or the like can be securely maintained in the folded condition by folding this in two and thereby locking the upper and lower bars 21, 23 to each other, followed by pulling the sheath-like bag 1 substantially over the folded cover section 22.

As a consequence, the problem having been encountered by the prior art that the bag often becomes inflated i.e. bulges during conveyance is effectively avoided and the other problem that the upper and lower bars are unlocked from each other during conveyance is also eliminated by a sufficient locking force provided by the present invention.

While the invention has been particularly shown and described with reference to preferred embodiment thereof, it will be understood by those skilled in the art that the foregoing and other changes in form and details can be made therein without departing from the spirit and scope of the invention.

What is claimed is:

1. In a portable clothes cover having an upper bar formed with a suspension member on which a hanger or the like can be suspended, a cover section extending downwardly from said upper bar, a lower bar transversely disposed at the lower end of said cover section, and engagable locking means associated with said upper and lower bars for releasably locking said bars together when said cover section is folded such that the said bars are in juxtaposition to each other, the improvement comprising a sheath-like bag extending from said upper bar, wherein said bag is so configured that when said bars are locked together, the bag is disposable over substantially the entire folded cover section by pulling the bag over the folded cover section while turning the bag inside out, whereby clothes being carried in said portable clothes cover remain in a substantially flat configuration.

2. Portable clothes cover as recited in claim 1, wherein the suspension member is centrally disposed on said upper bar.

3. Portable clothes cover as recited in claim 1, wherein the sheath-like bag is made of soft resin film.

4. Portable clothes cover as recited in claim 1, wherein the cover section is made of soft resin film and provided in the front side with an opening.

5. Portable clothes cover as recited in any one of claims 1 or 2 through 4, further comprising a grip formed on the lower bar and a cutaway portion provided in the sheath-like bag for passage of said grip therethrough.

6. Portable clothes cover as recited in claim 5, further comprising a gate-shaped bar disposed substantially parallel to the lower bar and disposed towards said upper bar.

7. Portable clothes cover as recited in claim 6, further comprising a hook extending from the upper bar at a middle portion thereof and in a direction remote from the said lower bar.

* * * * *